United States Patent [19]

Miles et al.

[11] 4,330,345

[45] May 18, 1982

[54] PHOSPHATE COATING PROCESS AND COMPOSITION

[75] Inventors: Donald L. Miles, Farmington Hills; Harry R. Charles, Sterling Heights, both of Mich.

[73] Assignee: Chemfil Corporation, Troy, Mich.

[21] Appl. No.: 214,537

[22] Filed: Dec. 8, 1980

[51] Int. Cl.[3] ..... C23F 7/10

[52] U.S. Cl. ..... 148/6.15 Z

[58] Field of Search ..... 148/6.15 Z

[56] References Cited

U.S. PATENT DOCUMENTS

| | | | |
|---|---|---|---|
| 1,610,362 | 12/1926 | Coslett | 148/6.15 Z |
| 1,911,726 | 5/1933 | Tanner | 148/6.15 Z |
| 2,121,574 | 6/1938 | Romig | 148/6.15 Z |
| 2,132,000 | 10/1938 | Curtin | 148/6.15 Z |
| 2,132,383 | 10/1938 | Romig | 148/6.15 Z |
| 2,310,239 | 2/1943 | Jernstedt | 148/6.15 Z |
| 2,314,887 | 3/1943 | Lodeesen | 148/6.15 Z |
| 2,375,468 | 5/1945 | Clifford et al. | 148/6.15 Z |
| 2,487,137 | 11/1949 | Hoover | 148/6.15 Z |
| 3,333,988 | 8/1967 | Douty | 148/6.15 Z |
| 3,346,426 | 10/1967 | Schlossberg | 148/6.15 Z |
| 3,619,300 | 11/1971 | Heller | 148/6.15 Z |
| 4,089,710 | 5/1978 | Cooke | 148/6.15 Z |

*Primary Examiner*—Ralph S. Kendall

*Attorney, Agent, or Firm*—Cullen, Sloman, Cantor, Grauer, Scott & Rutherford

[57] ABSTRACT

This invention relates to a method of coating a metal surface with zinc and iron phosphate crystals for the purpose of improving corrosion resistance by means of a buffered zinc phosphate solution containing zinc dihydrogen phosphate and a monovalent, alkali metal salt of phosphate in proportions such that a fine, horizontal crystal structure consisting of tertiary zinc phosphate, zinc ferrous phosphate and other crystals of zinc ferrous phosphate is formed on the metal surface. The invention also relates to this composition.

10 Claims, 5 Drawing Figures

PHOSPHATE COATING PROCESS AND COMPOSITION

BACKGROUND OF THE INVENTION

Conventional zinc phosphate solutions coat in two or more layers of platelets and needle-like crystals. The layer closest to the metal surface is comprised of various ferrous phosphates in the form of crystallized platelets, which provide a base for the formation of the needle-like components of the upper coating, hopeite. The size, quantity and orientation of these hopeite crystals are extremely important in providing dependable corrosion inhibition and paint bonding qualities. In a conventional zinc phosphate coating the crystals formed range in size from 20 to 50 microns or even larger (as illustrated in photomicrograph FIGS. 1 and 3). Such crystals tend to form in a random three dimensional configuration, including some vertical growth with results in relatively large interstices between the crystals. Such interstices, in combination with the vertical growth of the large crystals, have been shown to adversely affect the adhesion performance of some cationic electrocoats. Such paints are preferred in some applications because of their superiority in supporting the anti-corrosion capabilities of the zinc phosphate base.

THE PRIOR ART

| U.S. PAT. NO. | PATENTEE | DATE |
|---|---|---|
| 1,610,362 | COSLETT | 12/4/26 |
| 1,911,726 | TANNER | 5/30/33 |
| 2,121,574 | ROMIG | 6/21/38 |
| 2,132,883 | ROMIG | 10/11/38 |
| 2,487,137 | HOOVER | 11/8/49 |
| 2,310,239 | JERNSTEDT | 2/9/43 |
| 3,333,988 | DOUTY | 8/1/67 |
| 2,132,000 | CURTIN | 10/4/38 |

SUMMARY OF THE INVENTION

The present invention relates to a method of inhibiting corrosion of painted metal surfaces by the formation of phosphate coatings prior to paint application. More specifically, it relates to an aqueous phosphating solution which is capable of producing a coating of fine zinc and iron phosphate crystals with a predominantly horizontal attitude relative to the metal surface. Such a coating, when used in conjunction with cationically electrodeposited films, provides an excellent degree of corrosion protection and paint adhesion. Furthermore said aqueous phosphating solution produces a coating consisting primarily of tertiary zinc phosphate, or hopeite crystals; tertiary zinc ferrous phosphate, or phosphophllite; and other ferrous phosphates. The ratio of hopeite to the phosphophyllite and ferrous phosphates in the coating thus produced favors the ferrous compounds over the ratio found in conventional zinc phosphate. Thus the present invention will hereafter be referred to as zinc-iron phosphate coating process and composition. Said coating may be used with other siccative films, such as epoxies, enamels and other paints.

These and other objects will be seen from the following Specification and Claims in conjunction with the appended drawings.

THE DRAWINGS

It will be understood that the above drawings are merely illustrative of the prior art and the present method and composition, and that other embodiments are contemplated within the scope of the claims hereafter set forth.

DETAILED DESCRIPTION OF AN EMBODIMENT OF THE INVENTION

The present invention relates to a method of producing a phosphate coating on a metal surface possessing topographical characteristics that are desirable for the application of epoxide cationic electrocoats as described herein. By the addition of excess alkali metal ions in the form of a phosphate salt we have increased the iron to zinc ratio in the coating and have succeeded in producing hopeite and phosphophyllite crystals of the desired fineness and orientation for use with cationic electrocoat. Work in our laboratory in adding alkali metal salts of phosphate such as monosodium phosphate, disodium phosphate, monopotassium phosphate, and mono- or diammonium phosphate resulted in a refined morphology. Some of the favorable effects which were directly observable are an approximate 20% decrease in coating weight; an increase in the total acid of the bath by 2–3 points or more, with no increase in free acid; and a horizontally oriented crystal structure. This work soon led to the discovery that increased amounts of any of these salts led to an even finer morphology. The present invention uses an addition of from one-half to two mole of monosodium phosphate or other alkali metal phosphate salt to every mole of zinc dihydrogen phosphate present in solution. Popular usage refers to mole as a "gram molicular weight", that is, the number of grams of any substance in one mole is equal to the molecular weight of the substance in grams. A typical analysis of such a zinc-iron phosphate bath would be:

| | |
|---|---|
| Free Acid | 0.6 to 0.9 points |
| Total Acid | 15.0 to 17.0 points |
| Additive (sodium nitrite) | 0.005 to 0.1 g/liter |
| Zinc | 0.1 to 1.0 g/liter |
| Phosphate | 5 to 20 g/liter |
| Nitrate | 1 to 10 g/liter |

Figure 2:
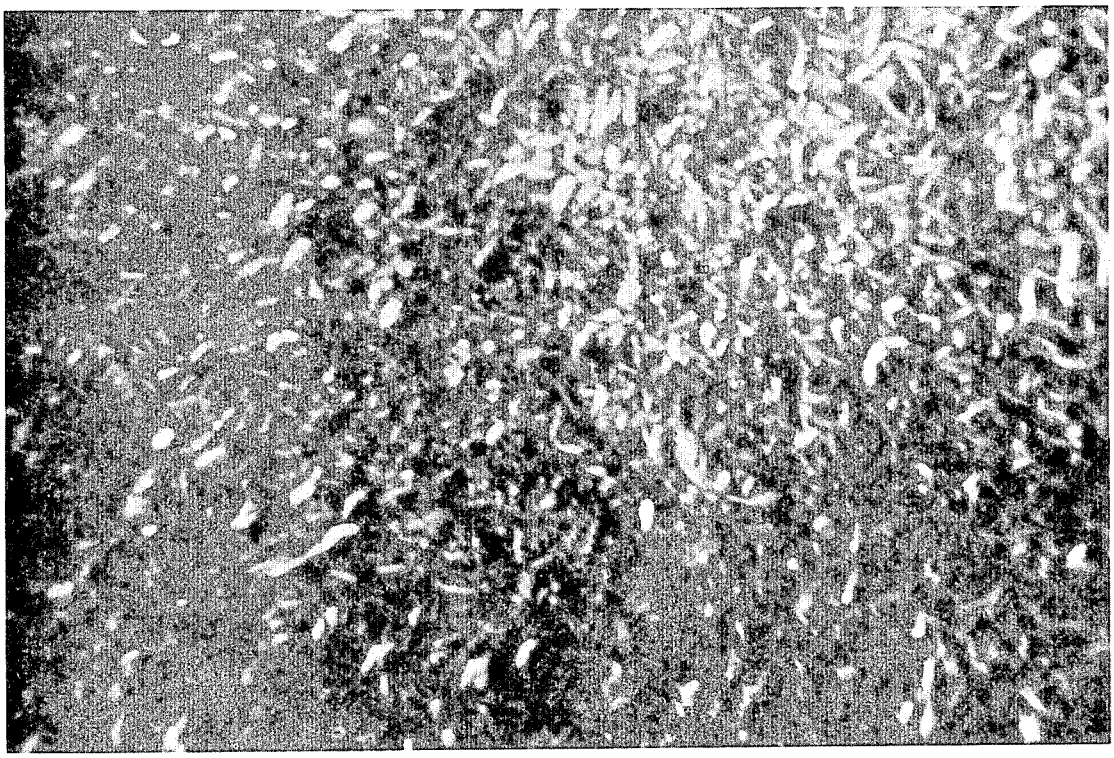
FIG. 2 is a similar view of a strip phosphate coated according to the present invention.
Figure 4:
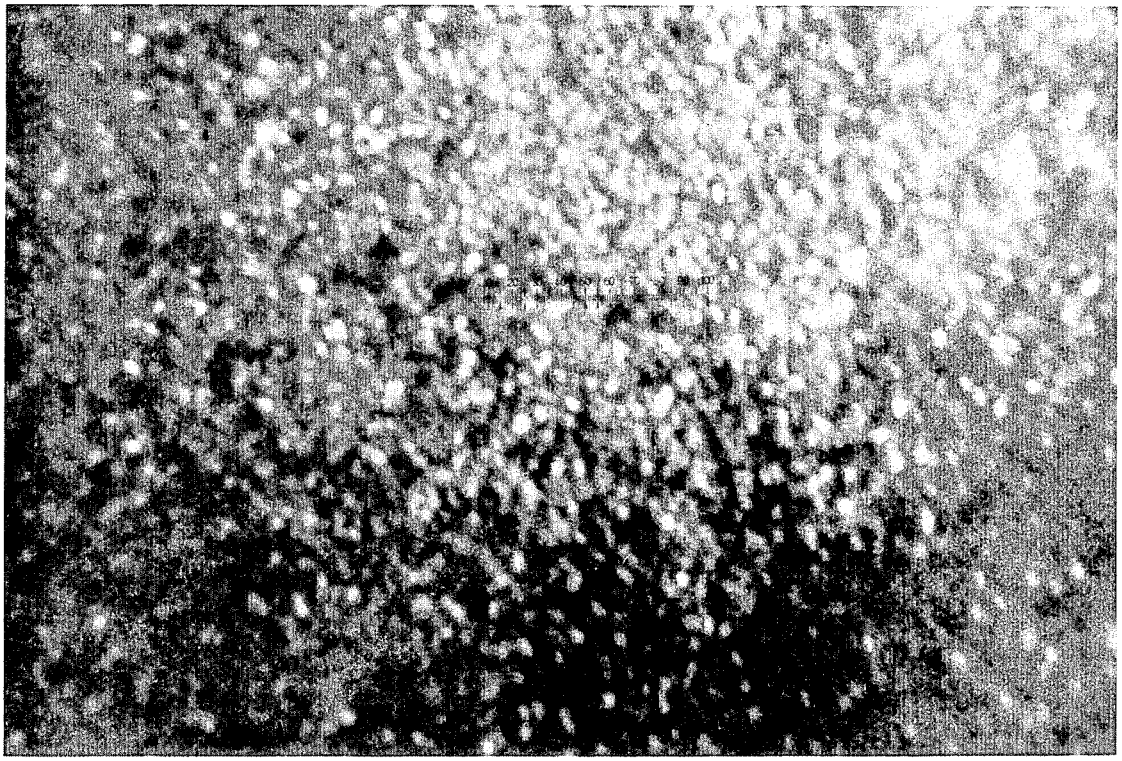
FIG. 4 is a similar view of a strip phosphate coated according to the present invention.
Figure 5:
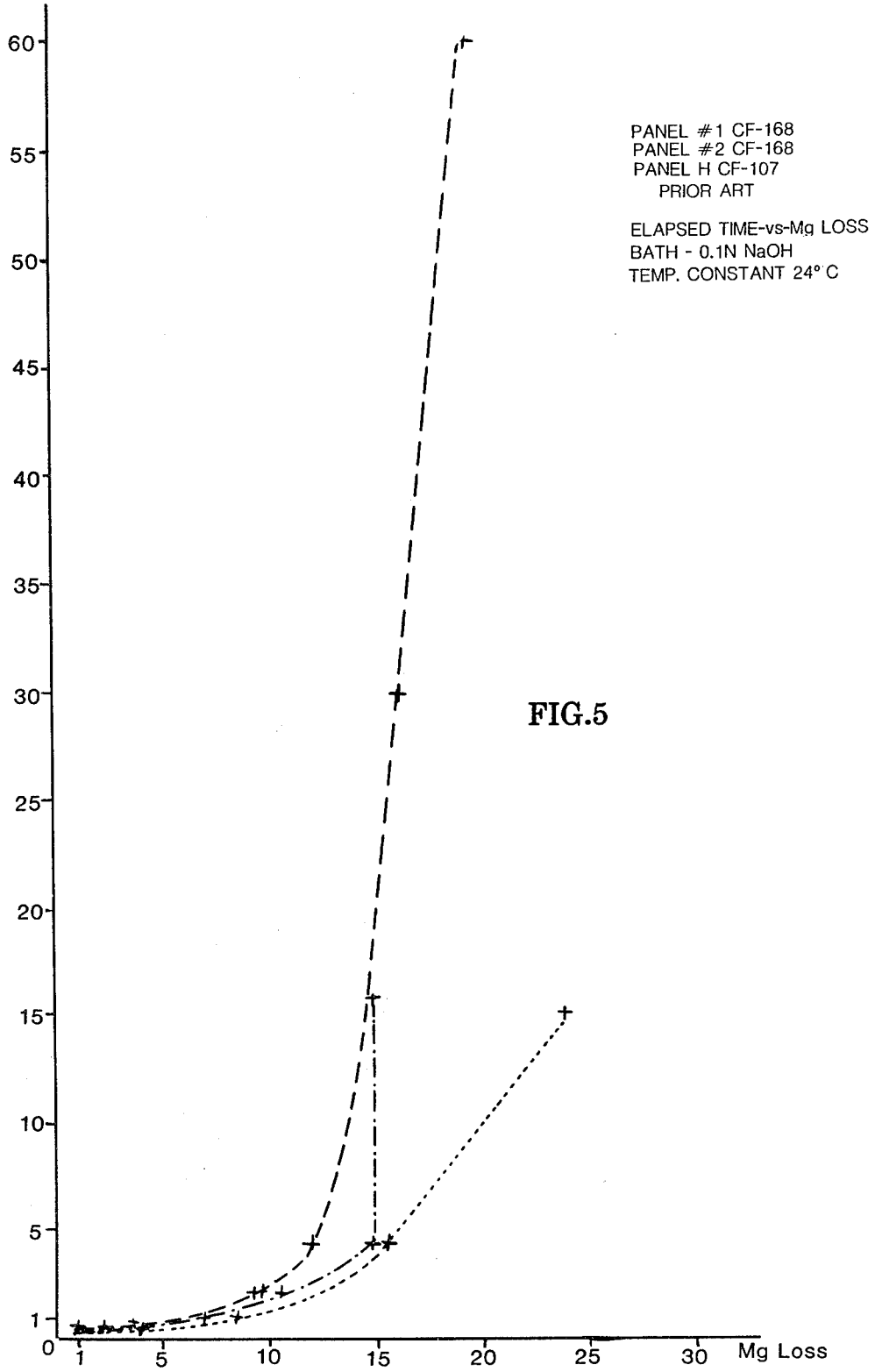
FIG. 5 is a graph illustrating reduced solubility of coatings of the present invention as compared to the prior art coatings.

Baths were also run with nickel salts, fluoride salts, sodium meta-nitrobenzene sulfonate, various surfactants, and sodium chlorate; all of which gave improvements in some properties of the zinc-iron coating. This is not to say that these are the only possible additives, but only a few examples. The crystals resulting from a zinc-iron phosphate bath range in size from 2 to 5 microns (as illustrated in photomicrographs FIGS. 2 and 4. An illustrative surfactant is Octyl Sulfate.

Coating weights as determined by gravimetric testing ranged from 75 to 250 milligrams per square foot throughout our testing of the zinc-iron bath. This is a low range when compared to conventional zinc phosphate which yields coating weights ranging from 150–350 milligrams per square foot. The phosphating art has generally been a compromise between high coating weights, which provide better corrosion resistance, and low coating weights, which show better physical properties such as adhesion, chip and impact resistance, etc. The present invention shows the improved physical characteristics associated with low coating weights, while providing dependable corrosion resistance, when used in conjunction with cathodic electrocoat paints, which is characteristic of highter coating weights.

The effectiveness of products in the metal finishing and fabricating art is determined by exposing painted metal test panels to environmental testing. Commonly used testing methods include the ASTM B-117 salt fog test; the five day humidity cross hatch, or Makawa test; the Cleveland condensing humidity test; outdoor exposure and indoor lab simulation scab corrosion studies. Tests which compare the present invention with conventional zinc phosphate were conducted on three different metal substrates: Cold Rolled Steel (CRS), galvanized steel (GS) and aluminum (AL). Cationically electrodeposited epoxide paint was applied as the primer for all the paint systems used in the testing discussed herein. Numerical evaluation of all results were obtained as described in ASTM D-1654.

The most significant of the tests performed in evaluating the present invention are the scab corrosion studies. Scab corrosion is the name given to a circular, blister-like lifting of the paint film which results when the integrity of the paint has been broken on metal surfaces exposed to warm and humid weather conditions. This type or corrosion is not normally detected in humidity or salt fog testing. To determine the resistance of phosphate paint systems to scab corrosion a painted panel or a finished product is scribed and subjected to approximately ten weeks or cyclical salt, temperature and humidity exposure, or approximately ten weeks of outdoor exposure with regular salt applications.

Testing of both conventional zinc phosphate and zinc-iron phosphate reveal that the horizontal growth and minute size of the crystals of the latter produce significant improvements in overall performance. The results of ASTM-B-117 salt fog tests of the zinc-iron phosphate indicate performance equal to or superior to those obtained from conventional zinc phosphate in the same test. Results from scab corrosion studies and five day humidity cross hatch tests show the zinc-iron phosphate as significantly superior to conventional zinc phosphate. The following examples of testing results will serve to illustrate the effectiveness of the present invention.

EXAMPLE #1:

The panels used in this test example were processed through a six-station procedure of the type used in most common zinc phosphating applications. The six stages used were as follows:

STAGE #1-Manual pre-wipe with a solvent.
STAGE #2-Spray application of hot alkali cleaner.
STAGE #3-Spray application of Jernstedt salts.
STAGE #4-Application by specified method (spray or immersion) of phosphating solution being tested.
STAGE #5-Spray application of ambient water rinse.
STAGE #6-Spray application of a specified final seal.
STAGE #7-(DI Rinse)

Each of the panels were then air dried before application of electrodeposited cationic epoxide primer and subsequent typical automotive topcoat films.

In this example the three substrate steels were processed through the six stages described, using zinc-iron phosphate or conventional zinc phosphate, as indicated, for stage #4-and three final seals. The operating parameters of the zinc-iron bath used were as indicated herein, while the parameters for the conventional zinc bath were optimum.

The final seals used are as follows: An ambient solution of chromate salts, hereafter referred to as Seal A; an ambient solution of trivalent chromium salts, which will hereafter be referred to as Seal B; and an ambient solution of non-chromate ammonium heptamolybdate as stated in U.S. Pat. No. 3,819,423, which will hereafter be referred to as Seal C. All panels in this example were exposed to ASTM Salt FOG Testing for 336 hours and then rated. The quality of each panel is determined as the amount of the paint film which is easily removed from the scribe vicinity. This is measured in one thirty-second division of an inch from the scribe to the edge of the paint failure. Adhesion performance was determined by scribing a 1.5 mm cross hatch grid followed by removal of the non-adhearing film by tape. The numerical rating for this aspect of the test is based on a system which ranges from a rating of 0 for no adhesion to one of 10 for perfect adhesion.

The table below shows the ASTM B-117 Salt Spray results obtained on panels processed as indicated. All panels represented were oven dried.

| PANEL NUMBER | SUBSTRATE | PHOSPHATE USED | FINAL SEAL | RATINGS | |
|---|---|---|---|---|---|
| | | | | SCRIBE CREEPAGE | ADHESION |
| 1 | CRS | Zinc-Iron | Seal A | less than 1/32" | 9 |
| 2 | CRS | " | Seal B | " | 9 |
| 3 | CRS | " | Seal C | " | 9 |
| 4 | CRS | ZINC | Seal A | " | 9 |
| 5 | CRS | " | Seal B | " | 9 |
| 6 | CRS | " | Seal C | " | 9 |
| 7 | GS | Zinc-Iron | Seal A | 1/32 | 9 |
| 8 | GS | " | Seal B | 2/32 | 7 |
| 9 | GS | " | Seal C | 10/32 | 0 |
| 10 | GS | ZINC | Seal A | 1/32 | 8 |
| 11 | GS | " | Seal B | 2/32 | 6 |
| 12 | GS | " | Seal C | 10/32 | 0 |
| 13 | Al | Zinc-Iron | Seal A | less than 1/32" | 9 |
| 14 | Al | " | Seal B | " | 9 |

-continued

| PANEL NUMBER | SUBSTRATE | PHOSPHATE USED | FINAL SEAL | RATINGS SCRIBE CREEPAGE | ADHESION |
|---|---|---|---|---|---|
| 15 | Al | " | Seal C | " | 9 |
| 16 | Al | ZINC | Seal A | " | 9 |
| 17 | Al | " | Seal B | " | 9 |
| 18 | Al | " | Seal C | " | 9 |

EXAMPLE #2:

For this example panels were processed as described in Example #1 and exposed to five days of constant humidity. The panels were then tested for adhesion by the method described in Example 190 1. The Table below shows the results of this testing.

| PANEL NUMBER | SUBSTRATE | APPLICATION METHOD | PHOSPHATE USED | FINAL SEAL | SCRIBE CREEPAGE | ADHESION |
|---|---|---|---|---|---|---|
| 1 | CRS | SPRAY | Zinc-Iron | Seal A | 1/32 | 9 |
| 2 | " | " | " | Seal B | 1/32 | 9 |
| 3 | " | " | " | Seal C | 2/32 | 9 |
| 4 | " | " | Zinc | Seal A | 2/32 | 8 |
| 5 | " | " | " | Seal B | 3/32 | 6 |
| 6 | " | " | " | Seal C | 5/32 | 4 |
| 7 | GS | " | Zinc-Iron | Seal A | 3/32 | 9 |
| 8 | " | " | " | Seal B | 3/32 | 9 |
| 9 | " | " | " | Seal C | 4/32 | 0 |
| 10 | " | " | Zinc | Seal A | 3/32 | 6 |
| 11 | " | " | " | Seal B | 4/32 | 5 |
| 12 | " | " | " | Seal C | 6/32 | 0 |
| 13 | Al | " | Zinc-Iron | Seal A | 2/32 | 9 |
| 14 | " | " | " | Seal B | 2/32 | 9 |
| 15 | " | " | " | Seal C | 3/32 | 9 |
| 16 | " | " | Zinc | Seal A | 2/32 | 9 |
| 17 | " | " | " | Seal B | 3/32 | 9 |
| 18 | " | " | " | Seal C | 3/32 | 9 |

EXAMPLE #3:

Test panels processed as described in Example #1 were exposed to warm, humid outdoor conditions for a period of 10 weeks. Each panel was sprayed with a 5% salt solution two times each week for the entire ten week period. The panels were then submitted to the same rating procedures described in example 1.

| PANEL NUMBER | SUBSTRATE | APPLICATION METHOD | PHOSPHATE USED | FINAL SEAL | ADHESION |
|---|---|---|---|---|---|
| 1 | CRS | SPRAY | Zinc-Iron | Seal A | 10 |
| 2 | " | " | " | Seal B | 9 |
| 3 | " | " | " | Seal C | 9 |
| 4 | " | " | Zinc | Seal A | 8 |
| 5 | " | " | " | Seal B | 6 |
| 6 | " | " | " | Seal C | 5 |
| 7 | GS | " | Zinc-Iron | Seal A | 8 |
| 8 | " | " | " | Seal B | 7 |
| 9 | " | " | " | Seal C | 0 |
| 10 | " | " | Zinc | Seal A | 6 |
| 11 | " | " | " | Seal B | 4 |
| 12 | " | " | " | Seal C | 0 |
| 13 | Al | " | Zinc-Iron | Seal A | 10 |
| 14 | " | " | " | Seal B | 10 |
| 15 | " | " | " | Seal C | 9 |
| 16 | " | " | Zinc | Seal A | 10 |
| 17 | " | " | " | Seal B | 9 |
| 18 | " | " | " | Seal C | 9 |

EXAMPLE #4:

Some panels processed through the procedure described in example 1 were exposed in a laboratory climate simulation test. This test involved a set cycle of salt, humidity and temperature variations designed to promote the formation of scab corrosion on the panels being tested. The panels were rated after the ten week test by the methods described in example #1.

| PANEL NUMBER | SUBSTRATE | PHOSPHATE USED | APPLICATION USED | FINAL SEAL | SCRIBE CREEPAGE | ADHESION |
|---|---|---|---|---|---|---|
| 1 | CRS | Zinc-Iron | SPRAY | SEAL A | 4mm | 9 |
| 2 | " | " | " | SEAL B | 6mm | 9 |
| 3 | " | " | " | SEAL C | 7.5mm | 9 |
| 4 | " | Zinc | " | SEAL A | 6mm | 7 |
| 5 | " | " | " | SEAL B | 7mm | 6 |

-continued

| PANEL NUMBER | SUBSTRATE | PHOSPHATE USED | APPLICATION USED | FINAL SEAL | SCRIBE CREEPAGE | ADHESION |
|---|---|---|---|---|---|---|
| 6 | " | " | " | SEAL C | 5mm | 7 |
| 7 | GS | Zinc-Iron | " | SEAL A | 2mm | 9 |
| 8 | " | " | " | SEAL B | 2mm | 9 |
| 9 | " | " | " | SEAL C | 4mm | 9 |
| 10 | " | Zinc | " | SEAL A | 3mm | 9 |
| 11 | " | " | " | SEAL B | 4mm | 9 |
| 12 | " | " | " | SEAL C | 4mm | 9 |
| 13 | Al | Zinc-Iron | " | SEAL A | 7mm | 9 |
| 14 | " | " | " | SEAL B | 7mm | 9 |
| 15 | " | " | " | SEAL C | 7mm | 9 |
| 16 | " | Zinc | " | SEAL A | 7mm | 9 |
| 17 | " | " | " | SEAL B | 7mm | 9 |
| 18 | " | " | " | SEAL C | 7mm | 9 |

The chemistry of a zinc phosphate bath operates on two different levels; the microscopic, that in the greater volume of the bath; and the microscopic, that near the metal surface being coated. The microscopic level is mostly concerned with reactions which provide an excess of fresh reactants for the microscopic reactions and which dispose of the waste products of the lower reaction level. On the microscopic level there are many different reactions taking place, some of which are not wholly understood as yet. It is this microscopic level of zinc phosphate chemistry which determines the structure of the zinc phosphate coating.

The actual coating reactions involved in a zinc phosphate bath are generally accepted as occuring in two separate steps. The first of these is the pickling process in which iron from the metal surface is dissolved in solution. The iron then reacts with the nitrite and phosphoric acid to form phosphate salts of ferric and ferrous iron and free hydrogen. Ferric phosphate is insoluble and immediately drops out of the solution. Ferrous phosphates either form crystalline structures on the metal surface or drift out beyond the newly formed 'hydrogen blanket' to be oxidized by nitrate into ferric iron which immediately forms ferric phosphate. As the iron reactions progress, the structure of the zinc phosphate in solution is attracted to the metal surface where it undergoes changes in its' structure, forming hopeite, and other zinc and iron phosphate crystals. In a conventional zinc phosphate coating the hopeite crystal dominates resulting in a coating with very little of the ferrous phosphate crystals.

As illustrative, but not limiting, the baths may operate effectively at temperatures of 115° F. to 132° F. approximately.

Through the addition of an alkali buffer in the form of a phosphate salt the formation of the coating is shifted, favoring the inclusion of the ferrous ions in the crystallization. Analysis of the coating indicates that adding an alkali metal salt of phosphate in the quantities specified increases the ferrous iron to zinc ratio from 1:7.5 in conventional zinc phosphate to 1:4.2 in the zinc-iron phosphate. This indicates that hopeite crystals exist in majority quantities in conventional zinc phosphates and that zinc-iron phosphate crystals, or phosphophyllite, favor the coating formed by the present invention.

Hopeite is defined as $Zn_3P_2O_8.4H_2O$ and phosphophyllite as $Zn_2FeP_2O_8.4H_2O$.

Table #1 shows the results of analysis of both conventional zinc phosphate coatings and zinc-iron phosphate coatings.

TABLE #1

Amounts of Ferrous Iron and Zinc in Conventional Phosphate vs. Zinc-Iron Phosphate

Figure 1:
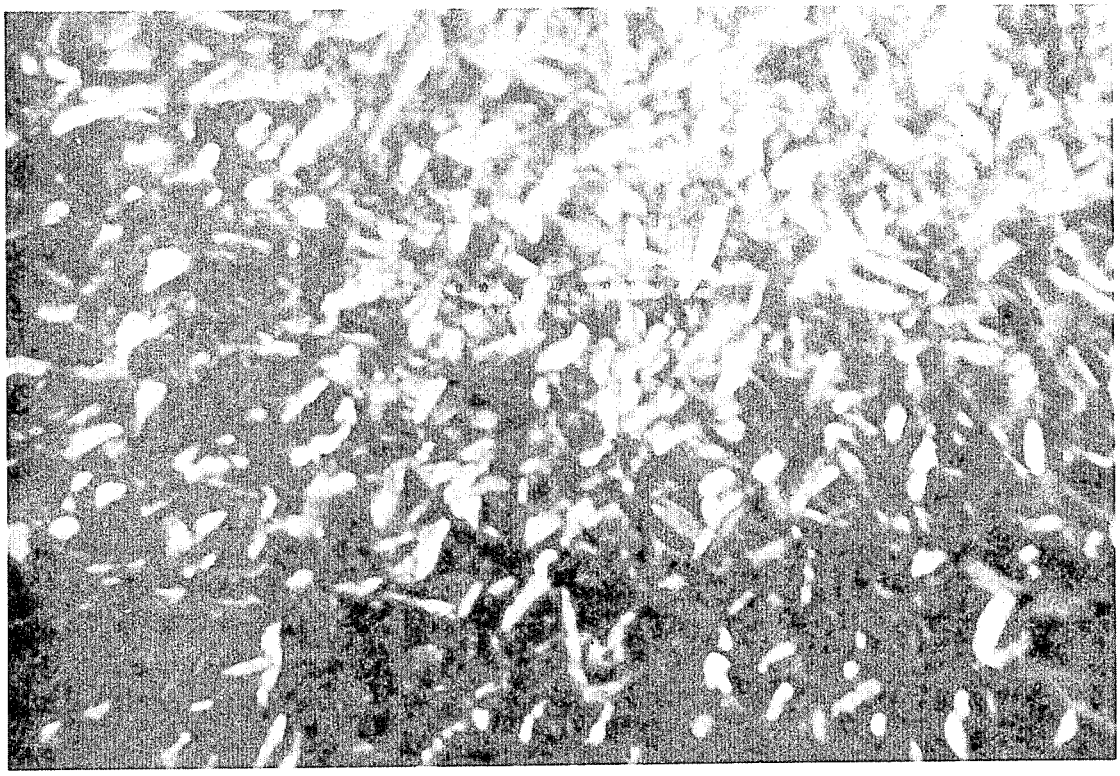
FIG.1 Prior Art
FIG. 1 is a reproduction of a photomicrograph of a metallic strip having a spray application of phosphate coating according to the prior art.
Figure 3:
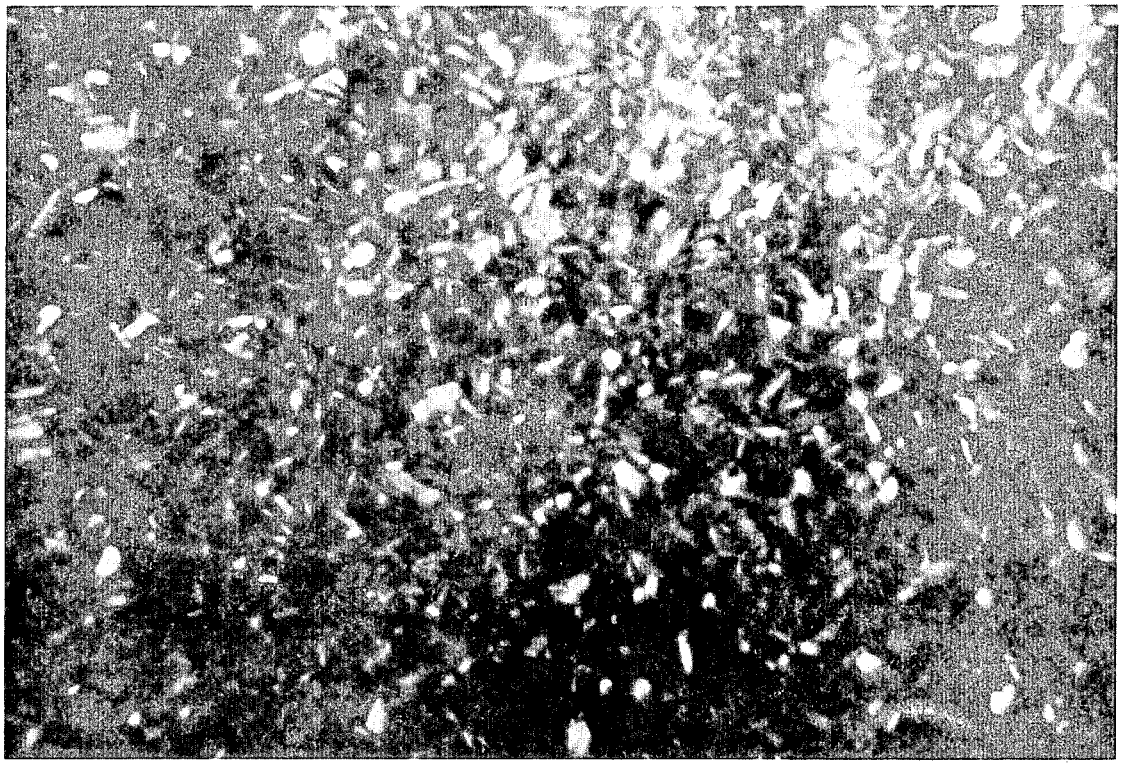
FIG.3 Prior Art
FIG. 3 is a reproduction of a photomicrograph of a metallic strip having a immersion application of phosphate coating according to the prior art.

| | Zinc Content of Coating | Ferrous Iron Content of Coating |
|---|---|---|
| FIGS. 1 and 3: Conventional Coating | 39.6% | 5.3% i.e., 7.5:1 |
| FIGS. 2 and 4: Zinc-Iron Coating | 34.4% | 8.1% i.e., 4.2:1 |

Solubility studies of conventional zinc phosphate versus zinc-iron phosphate in a 1/10 normal alkali solution, indicate that the zinc-iron phosphate coating is less soluble than the conventional zinc phosphate coating. FIG. #5 shown the plot of time vs. weight difference of the two different coatings.

The conditions of this study provide an accelerated lab simulation of the actual corrosion mechanism. Therefore, the results indicate that the zinc-iron phosphate coating tends to corrode at a slower rate than a conventional zinc phosphate coating.

The present composition and method may also apply to anionically electro deposited films, epoxies, enamel and other paints.

The following four examples of concentrates are illustrative of compositions that have been successfully used in the present method. Many other compositions could be used within the scope of the claimed method and compositions herein: (by weight)

| | 168 | 169 | 170 | 171 |
|---|---|---|---|---|
| ZINC OXIDE | 5% | 5.2% | 5.2% | 5.2% |
| PHOSPHORIC ACID | 28% | 28.1% | 28.1% | 28.0% |
| SODIUM HYDROXIDE | 4.6% | 4.6% | 4.6% | 4.5% |
| FLUORIDE, AMMONIUM | 0% | 1.0% | 0% | 0% |
| NICKEL OXIDE | 0% | 0.5% | 0.5% | 0% |
| HYDROFLUOSILICIC ACID | 0% | 0% | 1.0% | 0% |
| SURFACTANT | 0% | 0% | 0.5% | 0.5% |
| NITRIC ACID | 5.25% | 5.2% | 5.2% | 5.2% |
| WATER | 57.15% | 55.4% | 54.9% | 56.6% |

What we claim is:

1. A liquid concentrate for a phosphate coating solution for coating ferrous metal surfaces by spraying or emersion prior to painting, including cathodic electropainting, said concentrate comprising an aqueous solution of an alkali metal phosphate salt and zinc phosphate, wherein the ratio of said alkali metal phosphate salt to said zinc phosphate in the concentrate is from one-half to two moles of said alkali metal phosphate salt to one mole of said zinc phosphate, said concentrate supressing the zinc concentration in the phosphate coating solution to 0.1 to one gram per liter and producing a phosphate coating on metal surfaces treated by said phosphate coating solution enriched in zinc-iron-phosphate phosphophyllite compared to zinc phosphate hopeite, said phosphate coating having a generally horizontally oriented fine crystalline structure which is resistant to physical abuse and corrosion.

2. The liquid concentrate for the phosphate coating solution defined in claim 1, wherein said alkali metal phosphate salt is monosodium phosphate.

3. The liquid concentrate for the phosphate coating solution defined in claim 2, wherein said alkali metal phosphate is selected from the group consisting of monosodium phosphate, monopotassium phosphate, monoammonium phosphate, disodium phosphate, dipotassium phosphate and diammonium phosphate.

4. A method of spray phosphate coating a metal surface prior to painting, including cathodic electropainting, comprising spraying the metal surface to be treated with an aqueous solution of an alkali metal phosphate salt and zinc phosphate, resulting from the addition of a liquid concentrate containing an alkali metal phosphate and zinc phosphate wherein the ratio of said alkali metal phosphate salt to zinc phosphate is from one-half to two moles of said alkali metal phosphate salt to one mole of said zinc phosphate in said aqueous solution said concentrate supressing the zinc concentration in the phosphate coating solution to 0.1 to one gram per liter and producing a phosphate coating on said sprayed metal surface enriched in zinc-iron phosphate phosphophyllite compared to zinc phosphate hopeite, said phosphate coating having a ratio of zinc to iron of less than five to one and a generally horizontally oriented fine crystalline structure which is resistant to physical abuse and corrosion.

5. The method of spray phosphate coating a metal surface defined in claim 4, wherein said alkali metal phosphate salt is selected from the group consisting of monosodium phosphate, monopotassium phosphate, monoammonium phosphate, disodium phosphate, dipotassium phosphate and diammonium phosphate.

6. A method of phosphate coating a metal substrate by spray or emersion prior to painting, including electropainting, comprising contacting the surface of the metal substrate with an aqueous coating solution resulting from the addition of a liquid concentrate containing monosodium phosphate and zinc phosphate, wherein the ratio of said monosodium phosphate to said zinc phosphate is from one half to two moles of said monosodium phosphate to one mole of said zinc phosphate in said concentrate, said concentrate supressing the zinc concentration in said aqueous coating solution to 0.1 to one gram per liter and producing a phosphate coating on the contacted surfaces of said metal substrate enriched in zinc-iron-phosphate phosphophyllite compared to zinc phosphate hopeite, and said phosphate coating having a generally horizontally oriented fine crystalline structure which is resistant to physical abuse and corrosion.

7. An aqueous liquid concentrate for a phosphate coating solution for coating metal surfaces prior to painting, including an alkali metal phosphate salt and zinc phosphate, wherein the ratio of said alkali metal phosphate salt to said zinc phosphate is from one-half to two moles of said alkali metal phosphate salt to one mole of said zinc phosphate and said concentrate including the following additives, in approximate weight percent:

Zinc Oxide 5% to 5.2%
Phosphoric Acid 28% to 28.1%
Sodium Hydroxide 4.5% to 4.6%
Nitric Acid 5.20% to 5.25%
Water 54.9% to 57.15%.

8. The aqueous liquid concentrate for a phosphate coating solution defined in claim 7, including the following additional additives in approximate weight percent:

Flouride, Ammonium 1.0%
Nickel Oxide 0.5%
Hydrofluosilicic Acid 1%
Surfactant 0.5%.

9. An aqueous liquid concentrate for a phosphate coating solution for coating metal surfaces prior to painting, comprising monosodium phosphate and zinc phosphate, wherein the ratio of said monosodium phosphate to said zinc phosphate is from one-half to two moles of said monosodium phosphate to one mole of said zinc phosphate in said aqueous solution, and said aqueous solution including the following additives in approximate weight percent:

Zinc Oxide 5% to 5.2%
Phosphoric Acid 28% to 28.1%
Sodium Hydroxide 4.5% to 4.6%
Nitric Acid 5.20% to 5.25%
Water 54.9% to 57.15%.

10. The liquid concentrate for a phosphate coating solution defined in claim 9, including the following additives, in approximate weight percent:

Flouride, Ammonium 1.0%
Nickel Oxide 0.5%
Hydrofluosilicic Acid 1%
Surfactant 0.5%.

* * * * *